US005686709A

United States Patent [19]

Casagrande et al.

[11] Patent Number: 5,686,709

[45] Date of Patent: Nov. 11, 1997

[54] MODULAR TRIP BAR ASSEMBLY FOR MULTIPOLE CIRCUIT BREAKER

[75] Inventors: Robert Casagrande, Oxford; Erich J. Pannenborg; Andre J. M'Sadoques, both of Southington; Gary Paul Michaelis, Oakville, all of Conn.

[73] Assignee: General Electric Company, New York, N.Y.

[21] Appl. No.: 451,588

[22] Filed: May 26, 1995

[51] Int. Cl.[6] ..... H01H 75/00

[52] U.S. Cl. ..... 200/50.32; 200/50.4; 335/8

[58] Field of Search ..... 200/50 R, 500, 200/50.01, 50.32, 50.33, 50.34, 50.35, 50.37, 50.4, 18; 218/1, 2, 22, 23, 7, 154; 335/7–10, 17, 132, 172, 189–191, 37–40

[56] References Cited

U.S. PATENT DOCUMENTS

| | | | |
|---|---|---|---|
| 3,288,965 | 11/1966 | Klein et al. | 200/116 |
| 4,066,989 | 1/1978 | Krueger | 335/9 |
| 4,179,675 | 12/1979 | Perkins, Jr. | 335/9 |
| 4,620,171 | 10/1986 | Bagalini | 335/20 |
| 4,679,016 | 7/1987 | Ciarcia et al. | 335/132 |
| 4,827,231 | 5/1989 | Cheski et al. | 335/17 |
| 5,262,744 | 11/1993 | Arnold et al. | 335/8 |
| 5,479,143 | 12/1995 | Payet-Burin | 335/202 |

*Primary Examiner*—Michael L. Gellner
*Assistant Examiner*—Michael A. Friedhofer
*Attorney, Agent, or Firm*—Richard A. Menelly; Carl B. Horton

[57] ABSTRACT

A modular plastic trip bar assembly joins separate single pole molded case circuit breakers into a single multipole circuit breaker. The addition of the trip cam to the trip bar assembly allows four and five pole combinations to operate in unison.

4 Claims, 2 Drawing Sheets

MODULAR TRIP BAR ASSEMBLY FOR MULTIPOLE CIRCUIT BREAKER

BACKGROUND OF THE INVENTION

The introduction of American-made molded case residential circuit breakers into the European community requires the fabrication of four and five pole circuit breakers not commonly used within the United States.

Early attempts to join individual single pole circuit breakers by means of a common trip bar are described within U.S. Pat. No. 3,288,965 entitled "Multiple Circuit Breaker Assembly with Common Tripping" which limited the number of individual circuit breakers to a single pair to insure tripping in unison when one of the circuit breakers experienced an overload.

U.S. Pat. 4,066,989 entitled "Trip Unit Tie Bar Having Integral Flexibly Connected Links" and U.S. Pat. No. 4,179,675 entitled "Trip Bar Means Subassembly" describe flexible tie bars for multi-pole circuit breakers wherein the individual poles are designed to interrupt independently from each other.

In accordance with the requirement that all poles interrupt in unison upon occurrence of an overcurrent in any of the individual poles to prevent so-called "single phasing", an arrangement is required that is capable of converting four or five individual single pole circuit breakers into a unitary four or five pole circuit breaker with all poles interrupting in unison.

One purpose of the invention is to provide a modular trip bar that is operative with four and five individual circuit breakers and which causes the individual circuit breakers to trip in unison with minimum added cost.

SUMMARY OF THE INVENTION

A modular trip bar arrangement incorporates the individual trip cams integral with the trip bar to insure motivation of the trip assemblies in every pole of a multi-pole composite circuit breaker. The trip bar arrangement extends within each of the individual single pole circuit breakers within the composite circuit breaker to allow the individual cams to interact directly with the individual trip assemblies.

DESCRIPTION OF THE PREFERRED EMBODIMENT

Figure 1:
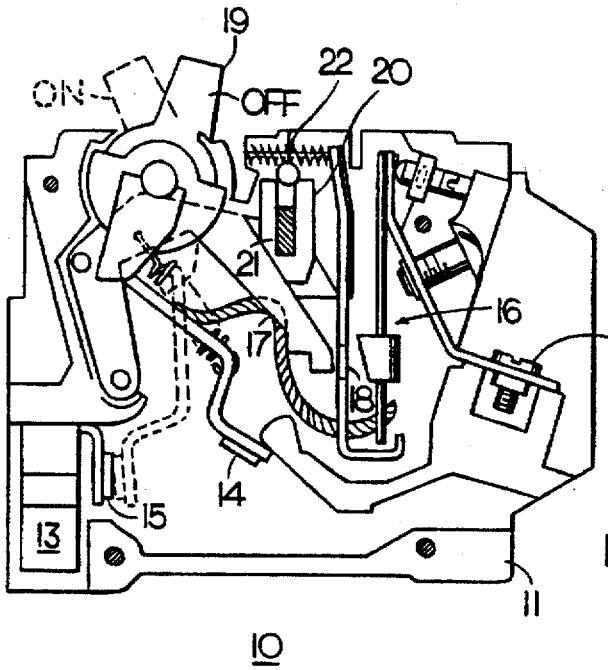
FIG. 1 is a side plan view of a molded case single pole circuit breaker with the cover removed to depict the current carrying components.

A standard single pole molded case circuit breaker produced in an automated assembly process is depicted at 10 in FIG. 1. The circuit breaker operates in the manner described in aforementioned U.S. Pat. No. 3,288,965 and consists of a molded plastic case 11 to which external electric connection is made by means of the load terminal 12 at one end and the line terminal 13 at the opposite end thereof. The contacts 14,15 become separated to interrupt circuit current in response to the operation of the thermal-magnetic trip unit 16 whereby the end of the cradle 17 releases from the latch 18 and drives the top part of the cradle against the trip cam 20 that carries the trip bar 21, shown in section. The trip cam is pivotally supported on a hub (not shown) that is integrally-formed on the interior surface of the case 11 by means of the pivot pin 22.

Figure 2:
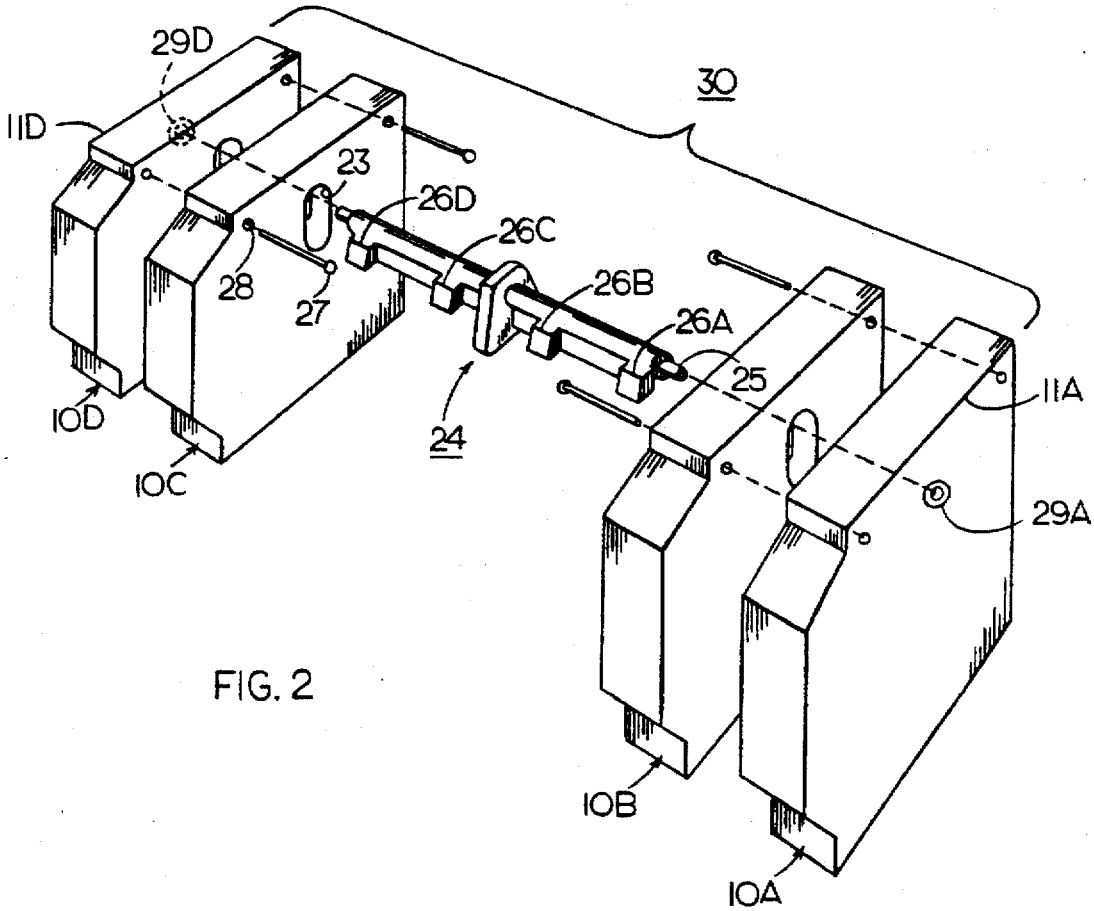
FIG. 2 is a top perspective view of four single pole circuit breakers prior to insertion of the modular trip bar according to the invention.
Figure 4:
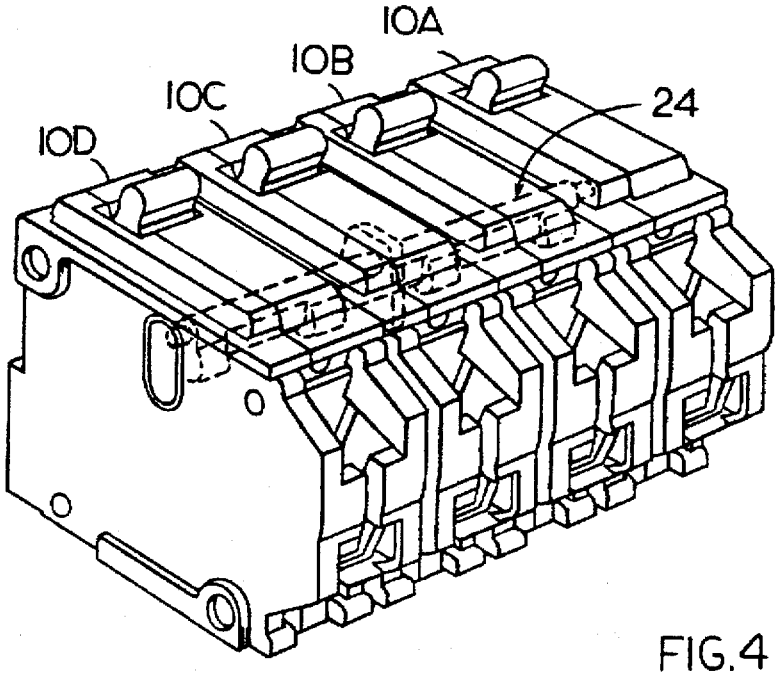
FIG. 4 is a top perspective view of the four single pole circuit breakers of FIG. 2 after insertion of the modular trip bar according to the invention.

Rather than manufacture increasingly larger multi-pole circuit breakers, it is economically advantageous to join individual single pole circuit breakers together to form a multi-pole composite circuit breaker 30, as shown in FIGS. 2 and 4, and employ a common trip mechanism in the form of the modular trip bar 24 to insure that the individual circuit breakers trip in unison. The single pole circuit breakers 10A–10D are aligned such that the apertures 23 are on-center to receive the modular trip bar 24 and the through-holes 28 are aligned to receive the attachment rivets 27. The trip cam 20, of FIG. 1, is omitted from the individual circuit breakers and the modular trip bar 24 is shaped to include integrally-formed trip cams 26A–26D on the plastic carry rod 25. Also integrally-formed with the trip cams is a central phase barrier unit 31 that insures that any gaseous byproducts generated during circuit interruption in the individual circuit breakers 10A,10B are not transmitted to the individual circuit breakers 10C, 10D and visa versa. The rear wails 11A, 11D of the two outermost circuit breakers 10A, 10D are left intact so that the corresponding hubs 29A,29D receive and support the ends of the carry rod 25. To facilitate rotational response of the rod, lubricating grease can also be applied to the ends.

Figure 3:
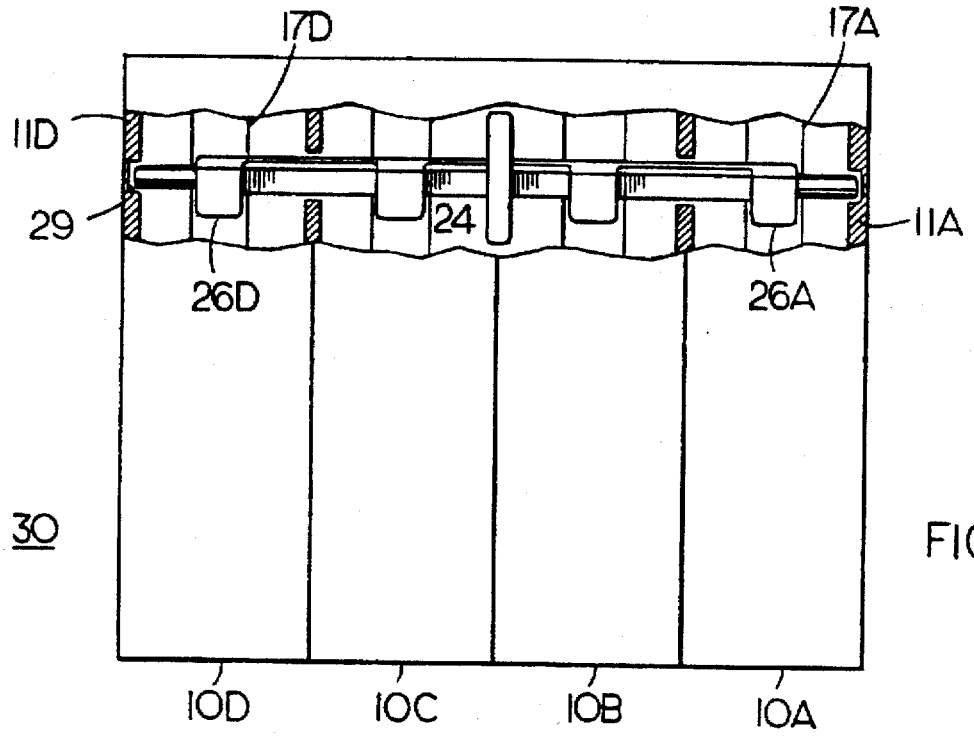
FIG. 3 is a front plan view of the four single pole circuit breakers of FIG. 2, in partial section, joined to form a composite four pole circuit breaker.

With the composite multi-pole circuit breaker 30 assembled, as now depicted in FIG. 3, the modular trip bar 24 extends across the individual circuit breakers 10A–10D such that the integral trip cams 26A–26D exactly align with the corresponding cradles 17A–17D whereby the displacement of any of the individual cradles into contact with the corresponding trip cam is sufficient to rotate the remaining cams within the remaining individual circuit breakers into the corresponding latches 18 (FIG. 1) causing the remaining cradles to release and separate each of the associated contacts to open all the circuits connected with the composite multi-pole circuit breaker 30.

A reliable and inexpensive modular tie bar for combining a plurality of individual single pole circuit breakers into a composite multi-pole circuit breaker has herein been disclosed. The composite multi-pole circuit breaker finds application in the European industrial community.

We claim:

1. A multi-pole composite circuit breaker comprising:

a plurality of single pole circuit breakers, a first of said single pole circuit breakers including a thermal-magnetic trip unit, separable contacts, a first latch and a first operating cradle all within a first molded plastic case, said first cradle interacting with said first latch to interrupt said contacts upon occurrence of an overcurrent; and a modular trip bar, said trip bar comprising a support post having a plurality of trip cams integrally-formed thereon, one of said trip cams interacting with a second latch within a second one of said single pole circuit breakers to move said second latch away from a second cradle when said first cradle interacts with said first latch.

2. The multi-pole composite circuit breaker of claim 1 wherein said trip cams are integrally-formed with said support post.

3. The multi-pole composite circuit breaker of claim 1 including a phase barrier block integrally-formed on said support post intermediate said trip cams for blocking transfer of gaseous byproducts between said first and second single pole circuit breakers.

4. The multi-pole composite circuit breaker of claim 1 wherein said modular trip bar comprises plastic.

* * * * *